US008698728B2

(12) United States Patent
Santo et al.

(10) Patent No.: US 8,698,728 B2
(45) Date of Patent: Apr. 15, 2014

(54) APPARATUS FOR INTEGRATED BACKLIGHT AND DYNAMIC GAMMA/VCOM CONTROL ON SILICON CHIPS

(75) Inventors: Hendrik Santo, San Jose, CA (US); Dilip Sangam, Saratoga, CA (US); Manish Kulkarni, Fremont, CA (US)

(73) Assignee: Atmel Corporation, San Jose, CA (US)

( * ) Notice: Subject to any disclaimer, the term of this patent is extended or adjusted under 35 U.S.C. 154(b) by 460 days.

(21) Appl. No.: 12/610,941

(22) Filed: Nov. 2, 2009

(65) Prior Publication Data

US 2011/0102450 A1 May 5, 2011

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 5,594,464 | A | 1/1997 | Tanaka et al. | |
| 6,452,582 | B1 | 9/2002 | Rolston | |
| 7,259,769 | B2 | 8/2007 | Diefenbaugh et al. | |
| 2003/0090455 | A1 * | 5/2003 | Daly | 345/102 |
| 2006/0208984 | A1 | 9/2006 | Kim et al. | |
| 2006/0208999 | A1 | 9/2006 | Lee et al. | |
| 2007/0052664 | A1 | 3/2007 | Hirakata et al. | |
| 2007/0109252 | A1 * | 5/2007 | Shin et al. | 345/102 |
| 2007/0176888 | A1 * | 8/2007 | Hattori et al. | 345/102 |
| 2007/0200808 | A1 | 8/2007 | Lee | |
| 2008/0001944 | A1 | 1/2008 | Chang | |
| 2008/0036729 | A1 * | 2/2008 | Mukuda | 345/102 |
| 2008/0062106 | A1 | 3/2008 | Tseng | |
| 2008/0079688 | A1 | 4/2008 | Yang et al. | |
| 2008/0150853 | A1 | 6/2008 | Peng et al. | |
| 2008/0224986 | A1 | 9/2008 | Huang et al. | |
| 2009/0174645 | A1 | 7/2009 | Kim et al. | |
| 2009/0179848 | A1 | 7/2009 | Schmidt et al. | |
| 2009/0251400 | A1 | 10/2009 | Liu et al. | |
| 2009/0267917 | A1 | 10/2009 | Lee et al. | |

OTHER PUBLICATIONS

U.S. Authorized Officer, Copenheaver, Blaine R., International Search Report and Wntten Opinion for PCT/US2010/055003 dated Dec. 30, 2010, 14 pages.
Understanding Dynamic Range in Digital Photography; Aug. 19, 2009; 5 pages.
International Preliminary Report; Baharlou; May 18, 2012; World Intellectual Property Organization (WIPO) (International Bureau of); PCTUS2010055003; 11 pages.
Cheng et al; Power Minimization in a Backlit TFT-LCD Display by Concurrent Brightness and Contrast Scaling; Feb. 16, 2004.
Haan et al; An Overview of Flaws in Emerging Television Displays and Remedial Video Processing; Aug. 2001.

* cited by examiner

*Primary Examiner* — Long D Pham
(74) *Attorney, Agent, or Firm* — Fish & Richardson P.C.

(57) ABSTRACT

Integrated backlight unit (BLU) and liquid crystal systems and circuits in liquid crystal display (LCD) systems are described. An LCD system can include a BLU to emit light at different intensities, and a BLU controller coupled to the BLU and configured to control the intensities. An LCD unit can receive the emitted light, and emanate light at a selected luminosity. The LCD unit can include pixels corresponding to: a liquid crystalline medium to provide a transmittance of the light emitted or to transmit a color light; and transistors adapted to modulate reference voltages. An LCD unit controller can be coupled to the LCD unit and configured to control luminosity of the light emanated from the LCD unit. The BLU and the LCD unit, which can be integrated in a single integrated circuit, can be controlled during concurrent time periods for contrast enhancement of images displayed from the LCD unit.

8 Claims, 13 Drawing Sheets

APPARATUS FOR INTEGRATED BACKLIGHT AND DYNAMIC GAMMA/VCOM CONTROL ON SILICON CHIPS

BACKGROUND

I. Field

The following description relates to electronic display technology, in general, and to backlight and liquid crystal drivers in liquid crystal display (LCD) systems, in general.

II. Background

The proliferation of LCD systems using backlights has increased significantly with the onslaught of consumer portable devices such as cell phones and personal digital assistants. In conventional systems, the intensity of the backlight is not changed as backlights have typically been single light sources. The singularity of the light sources used has prevented the ability to control portions of the backlight to emit light at different intensities or to control the backlight to any extent beyond merely turning the backlight on and off. Such limited use of the backlight and predominant reliance on controlling the LCD unit of the LCD system has resulted in LCD systems that provide poor contrast and fail to utilize the full range of human vision. Accordingly, there is a desire for systems, circuits and methods for contrast enhancement in LCD systems. Additionally, integrated circuits that can drive LCD backlights and liquid crystal transmission are proposed.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

Circuits for integrating the backlight unit (BLU) and the liquid crystal (LC) drivers (also known as liquid crystal cell controller electronics) on a chip are disclosed herein. The circuits can leverage the fact that both the drivers can accept similar timing controllers and have similar processing circuits. LC drivers can control the LC transparency. By way of example, but not limitation, LC transparency can be typically controlled using a thin film transistor (TFT). By way of example, but not limitation, typically, Gamma voltage supplied to a TFT can be modified to control LC transmission characteristics. Accordingly, LC drivers can be the same as, or similar to, TFT Gamma voltage drivers for many displays. By way of example, but not limitation, LC transparency can be modified by modulating voltage supplied to a TFT drain, source and/or gate. Accordingly, embodiments disclosed herein can include a BLU intensity modulator and/or TFT drain, source and/or gate voltage controlling electronics residing on the same integrated circuit. The embodiments disclosed herein can provide image quality enhancement, contrast enhancement and/or motion artifact reduction by controlling the BLU controller and the LCD unit controller, which are integrated on a single chip.

In one embodiment, a monolithic integrated circuit is provided. The circuit can include: a backlight unit controller; a control circuit for the backlight unit controller; and a thin film transistor liquid crystal display gamma controller communicatively coupled to the control circuit. The control circuit can be adapted to perform timing or phasing control of the backlight unit controller.

In another embodiment, an LCD system can be provided. The LCD system can include: a backlight unit disposed to emit light at a plurality of intensities; a backlight unit controller operably coupled to the backlight unit and configured to control the plurality of intensities of the light emitted from the backlight unit. The LCD system can also include an LCD unit located adjacent to the backlight unit for receiving the light emitted from the backlight unit, and configured to be controlled to emanate light at a selected luminosity. The LCD unit can include a plurality of pixels. One or more of the plurality of pixels can correspond to: a portion of a liquid crystalline medium adapted to provide a transmittance of the light emitted from the backlight unit or to be controlled to transmit a color light; and a plurality of transistors adapted to control the LCD unit by modulating one or more reference voltages. The LCD system can also include an LCD unit controller operably coupled to the LCD unit and configured to control a luminosity of the emanated light. The backlight unit and the LCD unit can be configured to be controlled concurrently, and the LCD unit controller and the backlight unit controller can be fabricated on an integrated circuit.

In another embodiment, a method of operation of an LCD system is provided. The method can include: controlling emission of light at one or more of a plurality of intensities, during a first time period, wherein the emission of light is provided by a backlight unit, and the controlling is performed by a backlight unit controller operably coupled to the backlight unit. The method can also include: receiving the light emitted from the backlight unit, wherein the receiving is performed by an LCD unit located adjacent to the backlight unit, and comprising a plurality of pixels. One or more of the plurality of pixels corresponds to: a portion of a liquid crystalline medium adapted to provide a transmittance of the light emitted from the backlight unit or to be controlled to transmit a color light; and a plurality of transistors adapted to control the LCD unit by modulating one or more reference voltages. The method can also include: controlling the LCD unit to emanate light at a selected luminosity, for a selected plurality of pixels during a second time period, wherein the controlling the LCD unit is performed by an LCD unit controller operably coupled to the LCD unit. The LCD unit controller and the backlight unit controller can be fabricated on an integrated circuit.

In another embodiment, another monolithic integrated circuit can be provided. The circuit can include: a backlight unit controller; a control circuit for the backlight unit controller; and a thin film transistor liquid crystal display gamma controller communicatively coupled to the control circuit. The control circuit can be adapted to perform timing or phasing control of the backlight unit controller;

In another embodiment, another LCD system can be provided. The LCD system can include: a backlight unit disposed to emit light at a plurality of intensities; a backlight unit controller operably coupled to the backlight unit and configured to control the plurality of intensities of the light emitted from the backlight unit; and an LCD unit located adjacent to the backlight unit for receiving the light emitted from the backlight unit, and configured to be controlled to emanate light at a selected luminosity. The LCD unit can include a plurality of pixels. In some embodiments, each of the plurality of pixels can correspond to: a portion of a liquid crystalline medium adapted to provide a transmittance of the light emitted from the backlight unit or to be controlled to transmit a color light; and a plurality of transistors adapted to control the LCD unit by modulating one or more reference voltages. The LCD system can also include an LCD unit controller operably coupled to the LCD unit and configured to control a luminosity of the emanated light. The backlight unit and the LCD unit can be configured to be controlled concurrently, and the LCD unit controller and the backlight unit controller can be fabricated on the same integrated circuit.

In some embodiments, the backlight unit can include a plurality of light emitting diodes operably coupled to the backlight unit controller to be controlled to emit light at one of the plurality of intensities. In some embodiments, the liquid crystalline medium is a twisted nematic liquid crystal medium adapted to bend into one of a plurality of twist angles to provide the transmittance of the light emitted from the backlight unit.

In some embodiments, the LCD system also includes a plurality of gamma voltage generators and a plurality of gate data signal generators. One or more of the plurality of transistors is TFT that is a field effect transistor (FET) having: a drain coupled to one of the plurality of gamma voltage generators; a gate coupled to one of the plurality of gate data signal generators; and a source coupled to a storage capacitor that is coupled to a common voltage. In some embodiments, one or more of the gamma voltage generators is configured to output a gamma voltage signal for controlling a transmission of a color signal, and one or more of the gate data signal generators is configured to output a gate data signal for controlling a current flow from the drain to the source of the TFT coupled to the gate data signal generator.

In some embodiments, the LCD system can also include a plurality of first digital-to-analog converters or a plurality of second digital-to-analog converters. The gate of each TFT can be coupled to one of the plurality of gate data signal generators via a respective one of a plurality of first digital-to-analog converters, and the drain of each TFT can be coupled to one of the plurality of gamma voltage generators via a respective one of a plurality of second digital-to-analog converters.

In some embodiments, the LCD system also includes a timing controller configured to cause synchronized control of the backlight unit and the LCD unit. The timing controller can be operably coupled to the backlight unit controller and the LCD unit controller for outputting one or more signals adapted to be received by the backlight unit controller and the LCD unit controller. The one or more signals can be for causing the backlight unit controller to control one or more of the plurality of light emitting diodes to emit light at one of the plurality of intensities during a first time period, and the one or more signals can be for causing the LCD unit controller to control the LCD unit to emanate light at the selected luminosity during a second time period. The first time period can be concurrent with the second time period. In some embodiments, contrast enhancement can be achieved by controlling the backlight unit controller and the LCD unit controller.

In another embodiment, another LCD system is provided. The LCD system can include: a backlight unit disposed to emit light at a plurality of intensities; a backlight unit controller operably coupled to the backlight unit and configured to control the plurality of intensities of the light emitted from the backlight unit; and an LCD unit located adjacent to the backlight unit for receiving the light emitted from the backlight unit, and configured to be controlled to emanate light at a selected luminosity. The LCD unit can include a plurality of pixels. Each of the plurality of pixels can correspond to: a portion of a liquid crystalline medium adapted to provide a transmittance of the light emitted from the backlight unit or to be controlled to transmit a color light; and a plurality of transistors adapted to control the LCD unit by modulating one or more reference voltages. The LCD system can also include an LCD unit controller operably coupled to the LCD unit and configured to control a luminosity of the emanated light. The backlight unit and the LCD unit can be configured to be controlled concurrently, and the LCD unit controller and the backlight unit controller can be fabricated on the same integrated circuit. The display quality of the LCD system can be improved by controlling a backlight unit during the first time period and controlling the LCD unit for a selected set of pixels during the second time period. The backlight unit can be controlled by the backlight unit controller.

In some embodiments, the LCD unit is controlled using a TFT, and display quality of the LCD system can be improved by controlling the backlight unit intensity modulation and one or more voltages applied to the TFT. In some embodiments, the LCD unit is controlled using a TFT and the backlight unit controller controls the backlight unit intensity modulation.

In some embodiments, the TFT is controlled by controlling voltage or current at the drain or the source or the gate of the TFT. The LCD system can have a backlight unit modulator and electronics for controlling a TFT drain, source or gate voltage. The backlight unit modulator and the electronics can reside on the same integrated circuit. In some embodiments, the TFT is controlled by controlling the TFT gamma voltage. The LCD system can have a backlight unit controller and TFT gamma voltage controlling electronics residing on the same integrated circuit. In some embodiments, the LCD unit controls the gamma voltage modulation applied to either a source or a drain of a TFT of the LCD system.

In some embodiments, controlling the LCD unit includes: providing at least one gamma voltage signal to a drain of a TFT in a pixel of the LCD unit while maintaining a constant, or substantially constant, value of a voltage at a source and at a gate of the TFT. In some embodiments, the source is coupled to a storage capacitor indicative of liquid crystal for the TFT.

In some embodiments, the first time period can be concurrent with the second time period, and controlling the LCD unit can include alternating a direction of current flow across the TFT between a first direction and a second direction. In some embodiments, alternating the direction of current flow includes: providing a first voltage associated with the gamma voltage signal; and, subsequent to providing the current flow in the first direction, providing a second voltage associated with the gamma voltage signal. In some embodiments, the first voltage has a value greater than a value of the voltage at a common node so as to provide current flow in the first direction across the TFT. In some embodiments, the second voltage has a value less than a value of the voltage at the common node so as to provide current flow in the second direction across the TFT. The first direction can be a direction toward the common node, and the second direction can be a direction toward the drain.

In some embodiments, a first one of the one or more of the plurality of light emitting diodes is controlled to emit light by controlling a peak intensity of the first one of the one or more of the plurality of light emitting diodes to obtain a desired average gray scale value of the emitted light. In some embodiments, the first time period can be concurrent with the second time period.

In some embodiments, a first one of the one or more of the plurality of light emitting diodes is controlled to emit light by controlling a duty cycle of the first one of the one or more of the plurality of light emitting diodes. The duty cycle can be controlled to obtain a desired average gray scale value of the emitted light. In some embodiments, the first time period can be concurrent with the second time period.

In some embodiments, the transmittance of a certain set of pixels of the LCD unit can be fixed, or substantially fixed, while the backlight unit is controlled. Fixing the set of pixels while controlling the backlight unit can, in some embodiments, minimize motion artifacts displayed from the LCD unit.

In some embodiments, the first time period is not concurrent with the second time period for controlling the BLU and the LCD unit. In some embodiments, the first time period is concurrent with the second time period for controlling the BLU and LCD units. In some embodiments, the first time period is not concurrent with the second time period for controlling the BLU and the TFT voltages or currents. In some embodiments, the first time period is concurrent with the second time period for controlling the BLU and the TFT voltages or currents.

Toward the accomplishment of the foregoing and related ends, the one or more embodiments comprise the features hereinafter fully described and particularly pointed out in the claims. The following description and the annexed drawings set forth herein detail certain illustrative aspects of the one or more embodiments. These aspects are indicative, however, of but a few of the various ways in which the principles of various embodiments can be employed and the described embodiments are intended to include all such aspects and their equivalents.

DETAILED DESCRIPTION

Figure 1:
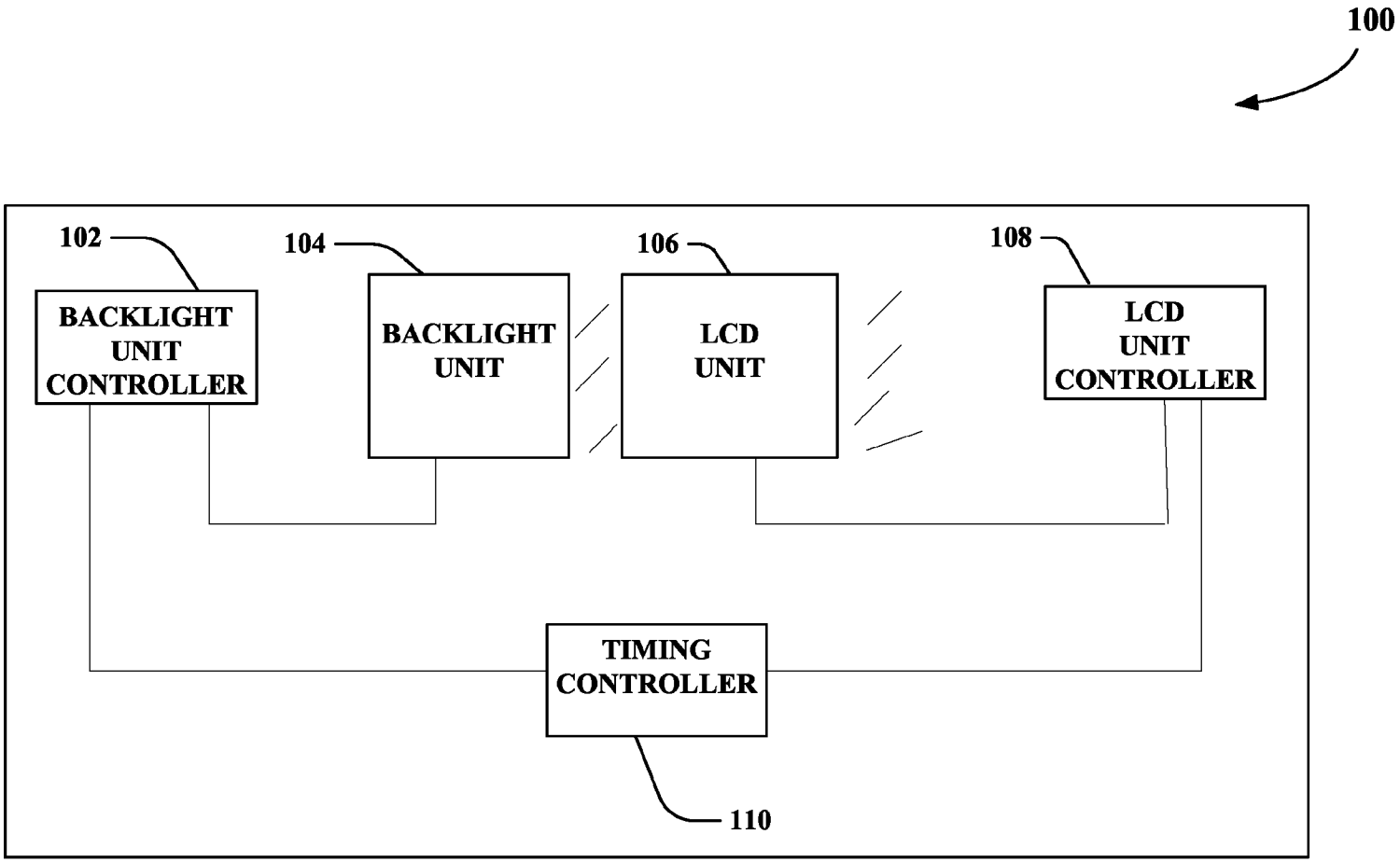
FIG. 1 is a block diagram of an LCD system in accordance with an embodiment of the present invention.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiments may be practiced without these specific details. In other instances, well-known structures and devices are shown in block diagram form in order to facilitate describing one or more embodiments.

Turning first to FIG. 1, a block diagram of a liquid crystal display (LCD) system in accordance with an embodiment of the present invention is illustrated. The LCD system 100 can include a backlight unit controller 102, a backlight unit 104, an LCD unit 106 and an LCD unit controller 108. In some embodiments, the LCD system 100 can also include a timing controller 110. The backlight unit controller 102 can be operably coupled to a backlight unit 104 and the LCD unit controller 108 can be operably coupled to the LCD unit 106. In embodiments including the timing controller 110, the timing controller 110 can be operably coupled to the backlight unit controller 102 and the LCD unit controller 108.

The luminosity of light emanated from a pixel of the LCD unit 106, I(x,y), can be modeled as a product of a transmissivity coefficient of a corresponding pixel of the LCD unit 106, Trans(x,y), and the intensity of light emitted from a corresponding pixel of the backlight unit 104, Illu(x,y) as follows:

$$I(x,y)=\text{Trans}(x,y)*\text{Illu}(x,y). \quad (1)$$

Accordingly, I(x,y) can be controlled by changing a value of Trans(x,y) and/or a value of Illu(x,y). In embodiments, wherein controlling Trans(x,y) is performed with 8-bits to 13-bits of resolution, and Illu(x,y) is typically left as a constant, the display contrast ratio, or dynamic range (Max intensity/Min intensity), in LCD systems can be limited to $2^8$ to $2^{13}$ gray levels. However, the human vision has a dynamic range of $2^{24}$ gray levels. Thus, the display quality of the LCD unit 106 can be improved by increasing the dynamic range of the LCD unit 106. In one or more embodiments described herein, the I(x,y) value can be controlled by simultaneously, or concurrently, controlling Trans(x,y) and/or Illu(x,y). In such embodiments, the values for Trans(x,y) and Illu(x,y) are changed (as opposed to leaving Illu(x,y) as a constant), and a wider dynamic range results, relative to systems that only change the value of Trans(x,y) while keeping the value of Illu(x,y) constant.

The LCD system 100 of FIG. 1 employs structures for providing such enhanced dynamic range. Referring back to FIG. 1, the backlight unit controller 102 can be any module capable of controlling the intensity of the light emitted from the backlight unit 104. By way of example, but not limitation, the backlight unit controller 102 can be hardware, software or a combination of hardware and software. The backlight unit controller 102 can control the backlight unit 104 independent of the timing and/or manner of control performed by the LCD unit controller 108 on the LCD unit 106.

In some embodiments, the backlight unit 104 can be any light source capable of emitting light. In various embodiments, the backlight unit 104 can be or include a cold cathode fluorescent lamp (CCFL), an incandescent light bulb, an electroluminescent panel (ELP) or a hot cathode fluorescent lamps (HCFL).

In some embodiments, the backlight unit 104 can be any light source disposed to emit light at any one of a plurality of intensities. In one embodiment, the backlight unit 104 can be a light source having a plurality of light emitting diodes (LEDs) (not shown). Each of the plurality of LEDs can be operably coupled to the backlight unit controller 102 to be controlled to emit light. Each of the LEDs can be configured to be controlled to emit light at any one of a plurality of intensities based on a control signal received from the backlight unit controller 102. Accordingly, a first LED can be controlled to emit light at a first one of the plurality of intensities while a second LED can be controlled to emit light at a second one of the plurality of intensities and colors (or frequencies). The intensity and/or color of the light emitted at the first LED can be independent of the intensity and/or color of the light emitted at the second LED. Accordingly, when the backlight unit 104 is a light source having a plurality of LEDs, the backlight unit 104 can be controlled by the backlight unit controller 102 to simultaneously or concurrently emit light at different intensities and, optionally, colors.

The LCD unit 106 can include a plurality of pixels wherein each of the plurality of pixels includes a corresponding portion of a liquid crystalline medium and a plurality of transistors adapted to control emission of a color light. In some embodiments, the transistors can be TFTs and the LCD unit 106 can be a TFT-LCD unit. The TFTs can be field effect transistors (FETs) in some embodiments.

In some embodiments the LCD unit can have a color filter configured to transmit light of one or more different colors or frequencies. In some other embodiments, the LEDs themselves can emit light of one or more different colors or frequencies.

In some embodiments, the display can be divided into a plurality of tiles. The smallest tile can have a size that is the same as, or substantially the same, as the size of a single pixel. An LED can control the intensity of the tile. The TFT can further refine the intensity of the pixel. Thus, the LED can act as a coarse intensity controller of the pixel. The TFT can act as a finer intensity controller of the pixel. For example, if image data are stored in 16-bits, the first 8 most significant bits can drive coarse intensity variation using the LED. The last 8 least significant bits can provide finer control over the intensity of the pixel by driving the TFT.

In some embodiments, the liquid crystalline medium is a twisted nematic liquid crystal ("TNLC") medium. The TNLC medium can be adapted to be controlled by the LCD unit controller 108 to bend into one of a plurality of twist angles. The twist angle to which the TNLC medium bends can determine a level of filtering of the light incident on the LCD unit 106 that is emitted from the backlight unit 104. As a result, the TNLC medium can provide a resultant transmittance of the emitted light from the LCD unit 106.

Figure 2:
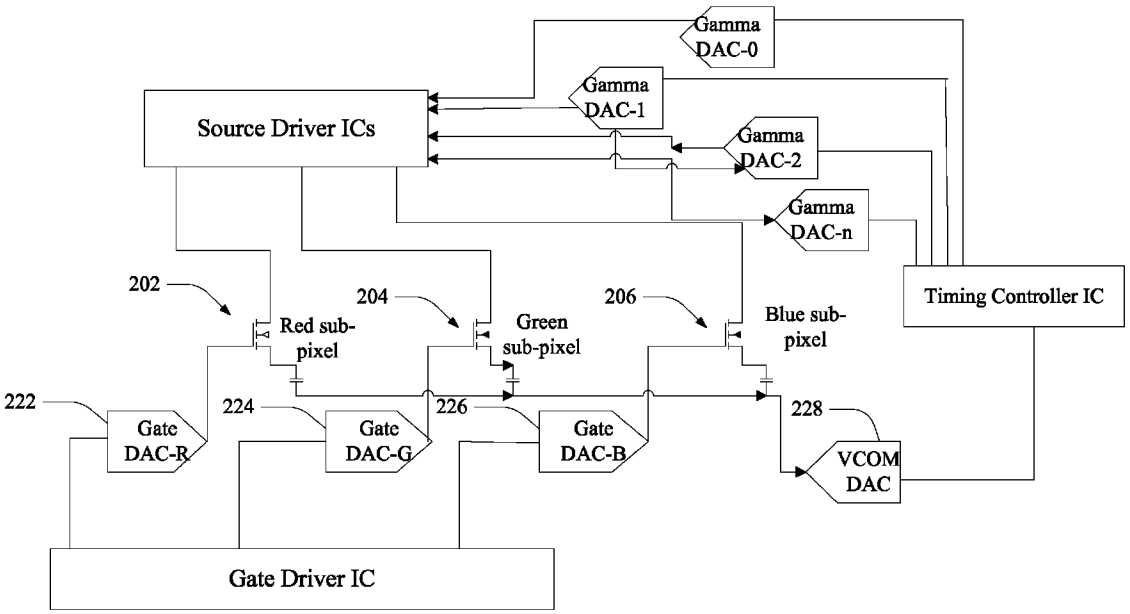
FIG. 2 is a schematic diagram of a pixel circuit of an LCD unit of the LCD system of FIG. 1 in accordance with an embodiment of the present invention.

FIG. 2 is a schematic diagram of a pixel circuit of an LCD unit of the LCD system of FIG. 1 in accordance with an embodiment of the present invention. With reference to FIGS. 1 and 2, in some embodiments of the LCD system 100, each of the plurality of pixels includes a pixel circuit. The pixel circuit can include at least three TFTs 202, 204, 206 adapted for controlling emission of red, blue and green light, respectively.

For each of the TFTs 202, 204, 206, the drain can be coupled to a drain digital-to-analog converter (DAC) that can be respectively coupled to a gamma voltage generator (not shown). The DAC can be configured to output an analog version of a gamma voltage signal received from the gamma voltage generator. In some embodiments, the drain DAC can be an 11-bit DAC for providing a gamma voltage for the TFTs dictating a brightness of the red, blue or green color emitted from the pixels. The gamma voltage received at each of the TFTs can be independent of the gamma voltage received at another TFT within the pixel or outside of the pixel. Accordingly, each pixel circuit can receive a gamma red voltage signal, a gamma blue voltage signal and/or a gamma green voltage signal for independently controlling a contribution of red, blue and green to the color generated in the LCD unit 106.

The gate of the TFT can be coupled to a gate DAC 222, 224, 226, which can be coupled to a gate data signal generator (not shown). The DAC 222, 224, 226 can be configured to output an analog version of a gate data signal received from the gate data signal generator. The gate data signal can control an amount of current flow from the drain to the source of the respective TFT 202, 204, 206. In some embodiments, the gate DAC 222, 224, 226 can be an 8-bit DAC. The source of each TFT 202, 204, 206 in the pixel circuit can be coupled to a common node, $V_{COM}$.

In some embodiments, the Gate voltage can perform a simple on/off operation for the TFT. In some embodiments, the common node is grounded at approximately zero volts. In other embodiments, the common node is any constant value and is maintained at a constant value and not changed when the gamma voltage is provided to the drain of the TFT. In some embodiments, the common node is coupled to a common node DAC 228.

Figure 3:
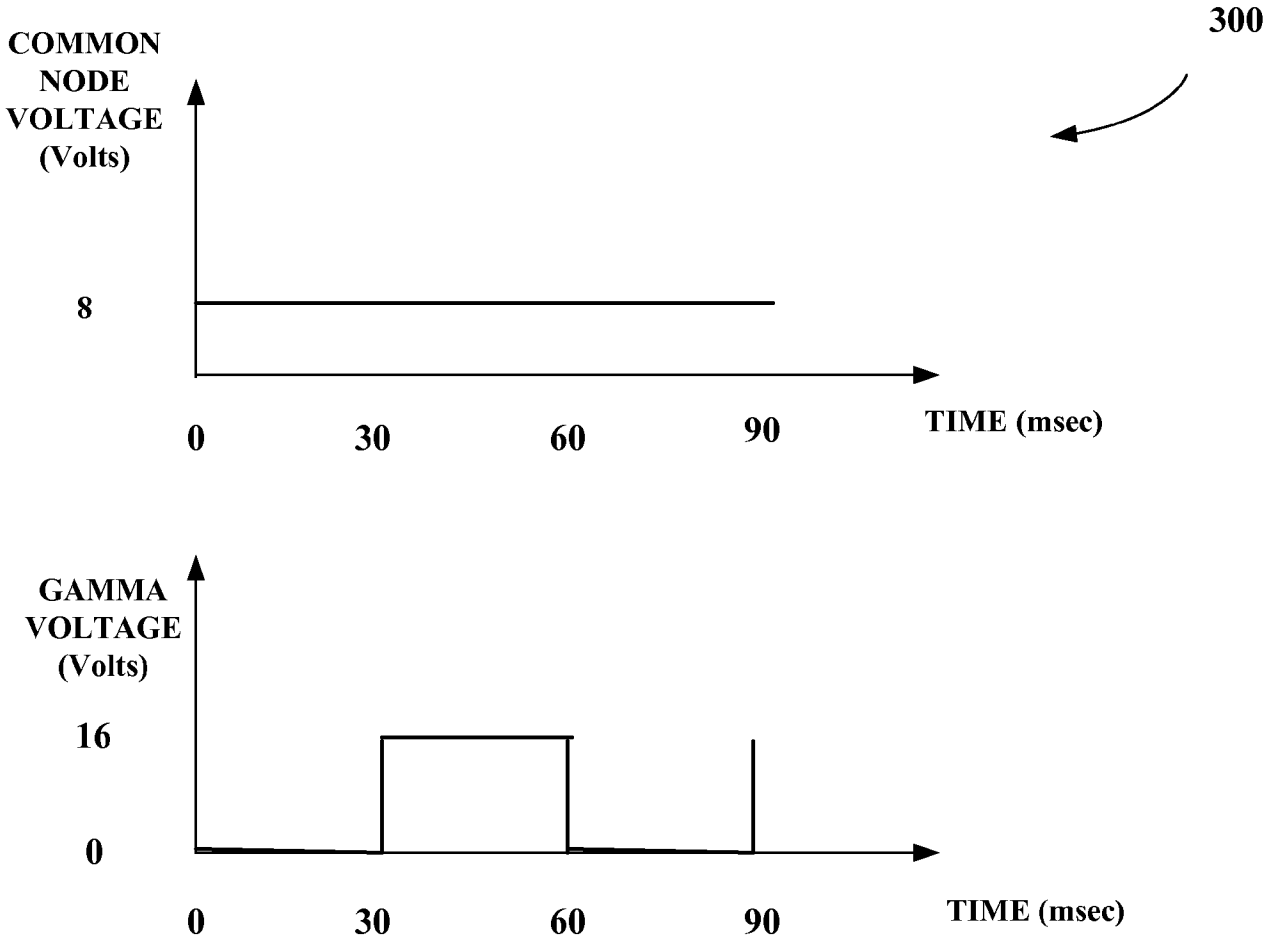
FIG. 3 illustrates waveforms depicting the gamma voltage and the voltage at a common node of the pixel circuit of FIG. 2 over time in accordance with an embodiment of the present invention.
Figure 4:
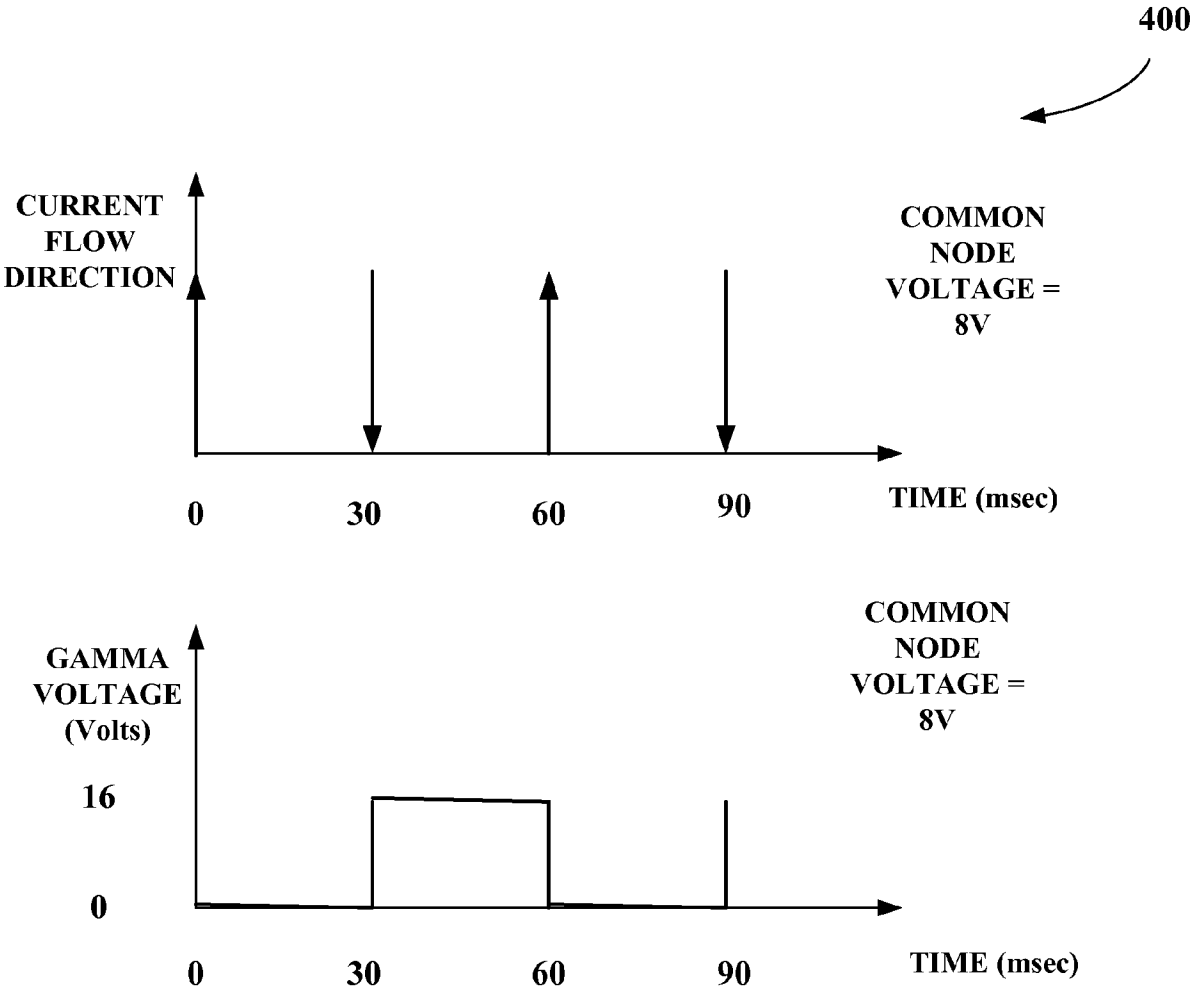
FIG. 4 illustrates graphs depicting the relationship between current flow and gamma voltage in the pixel circuit of FIG. 2 in accordance with an embodiment of the present invention.

FIG. 3 illustrates waveforms depicting the gamma voltage and the voltage at the common node of the pixel circuit of FIG. 2 over time. FIG. 4 illustrates graphs depicting the relationship between current flow and gamma voltage in the pixel circuit of FIG. 2. Referring to FIG. 3, as shown, the gamma voltage signal can be a square pulse. By way of example, but not limitation, the square pulse can alternate between values of 0 V and 16 V. The voltage at the common node can be maintained at a constant value. By way of example, but not limitation, the voltage at the common node can be maintained at 8 V.

Referring to FIG. 4, as shown, the gamma voltage signal can be controlled relative to the voltage at the common node. In various embodiments, the gamma voltage signal can be increased or decreased relative to the voltage at the common node. As a result, a direction of current flow across the TFT can be controlled. Specifically, the current can be provided in a first direction when the voltage corresponding to the gamma voltage signal is less than the voltage at the common node, and provided in a second direction when the voltage corresponding to the gamma voltage signal is greater than the voltage at the common node. By way of example, but not limitation, when the voltage at the common node is 8 V and the voltage corresponding to the gamma voltage signal is greater than 8 V (e.g., when the square pulse signal input to the drain is 16 V), current flows down from the drain of the TFT to the common node. When the voltage corresponding to the gamma voltage signal is less than 8 V (e.g., when the square pulse signal input to the drain is OV), current flows up from the common node towards the drain of the TFT. Accordingly, the direction of the current flow can be controlled. In some embodiments, alternating current direction and/or the use of DACs in the pixel circuit 200 can reduce the likelihood that burn-in will occur in the pixels of the LCD unit 106. As used herein, the term "burn-in" can mean the persistence of emission from the LCD pixel after the light corresponding to the image is no longer being controlled to be emanated. The term "burn-in" can also mean the persistence of transmittance or reflectance of the LCD pixel after the transmittance or reflectance corresponding to the pixel is no longer being controlled.

In some embodiments, the gamma voltage signal can be a ramp pulse. Accordingly, the amount of current flow across the TFT can be controlled according to the amount of the voltage corresponding to the gamma voltage signal. By way of example, but not limitation, if the voltage at the common node is 8V, when the gamma voltage is 8V+5 V, current flowing down to the voltage at the common node from the drain is greater than when the gamma voltage is 8V+3 V. Accordingly, the current flow is controlled based on the difference between the voltage corresponding to the gamma voltage and the voltage at the common node.

Referring back to FIG. 1, in embodiments, the LCD unit 106 is located adjacent to the backlight unit 104 for receiving the light emitted from the backlight unit 104, and can be configured to be controlled to emanate some amount of the emitted light from the backlight unit 104.

The LCD unit controller 108 can be any module capable of controlling the LCD unit 106. By way of example, but not limitation, the LCD unit controller 108 can be hardware, software or a combination of hardware and software. The LCD unit controller 108 can control the LCD unit 106 independent of the timing and/or manner of control performed by the backlight unit controller 102 on the backlight unit 104.

In various embodiments, the LCD unit controller 108 can be operably coupled to the LCD unit 106. The LCD unit controller can be configured to control a luminosity of light emanated from the LCD unit 106. In some embodiments, the emanated light can be the emitted light from the backlight unit 104 filtered by the LCD unit 106.

In some embodiments, the LCD unit controller 108 can control the LCD unit 106 by controlling a gamma voltage generator (not shown) to output a gamma voltage signal to the LCD unit 106. In some embodiments, the gamma voltage signal can control a transmittance of the LCD unit 106 by generating a voltage potential across a TFT of the LCD unit 106 that causes a TNLC material near the TFT to bend to a selected twist angle.

The backlight unit 104 and the LCD unit 106 of the LCD system 100 can be configured to be controlled concurrently by the backlight unit controller 102 and the LCD unit controller 108, respectively. In various embodiments, the backlight unit controller 102 and the LCD unit controller 108 can be configured to be operated independent of one another.

In some embodiments, the LCD system 100 can also include a timing controller 110. The timing controller 110 can be any module capable of controlling the LCD unit controller 108 and the backlight unit controller 102 such that control of the LCD unit 106 and the backlight unit 104 can be synchronized. In some embodiments, synchronizing the control includes controlling the backlight unit 104 and the LCD unit 106 during time periods that are concurrent or simultaneous. By way of example, but not limitation, the timing controller 110 can be hardware, software or a combination of hardware and software.

In some embodiments, the timing controller 110 can be operably coupled to the backlight unit controller 102 for outputting one or more signals adapted to be received by the backlight unit controller 102. The signal received by the backlight unit controller 102 can control the timing for the backlight unit controller 102 to control the backlight unit 104.

The timing controller 110 can also be operably coupled to the LCD unit controller 108 for outputting one or more signals adapted to be received by the LCD unit controller 108. The signal received by the LCD unit controller 108 can control the timing for the LCD unit controller 108 to control the LCD unit 106.

By way of example but not limitation, the one or more signals received by the backlight unit controller 102 and the LCD unit controller 108 can cause the backlight unit controller 102 and the LCD unit controller 108 to output signals for respectively controlling the backlight unit 104 and the LCD unit 106 during concurrent or non-concurrent time periods. In some embodiments, the one or more signals received by the backlight unit controller 102 and the LCD unit controller 108 can cause the backlight unit controller 102 and the LCD unit controller 108 to output signals for respectively controlling the backlight unit 104 and the LCD unit 106 simultaneously.

Figure 13A:
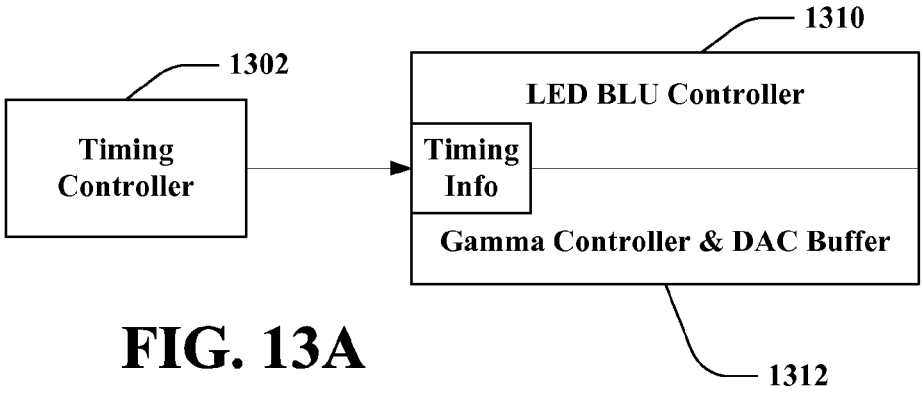
FIGS. 13A, 13B, 13C and 13D are block diagrams of circuits for controlling the BLU and the LCD unit.
Figure 13B:
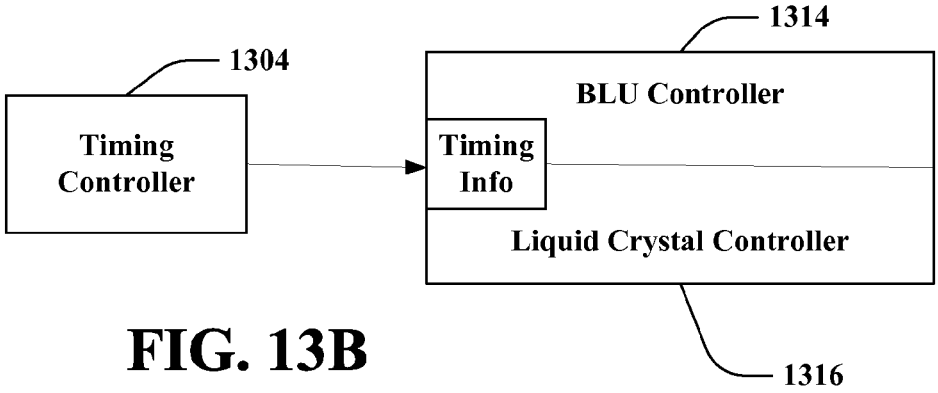
Figure 13C:
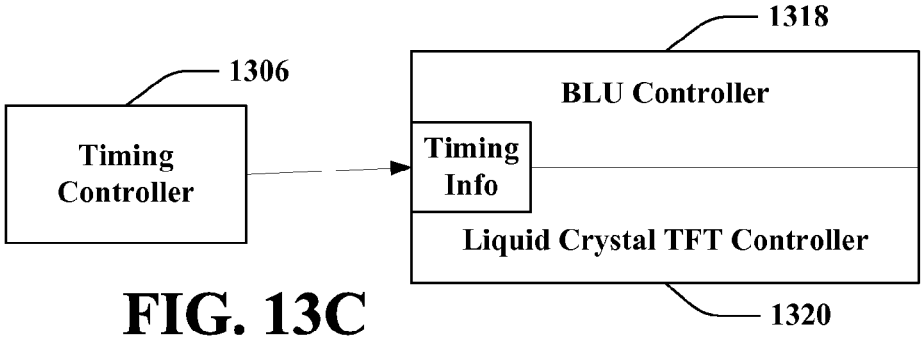
Figure 13D:
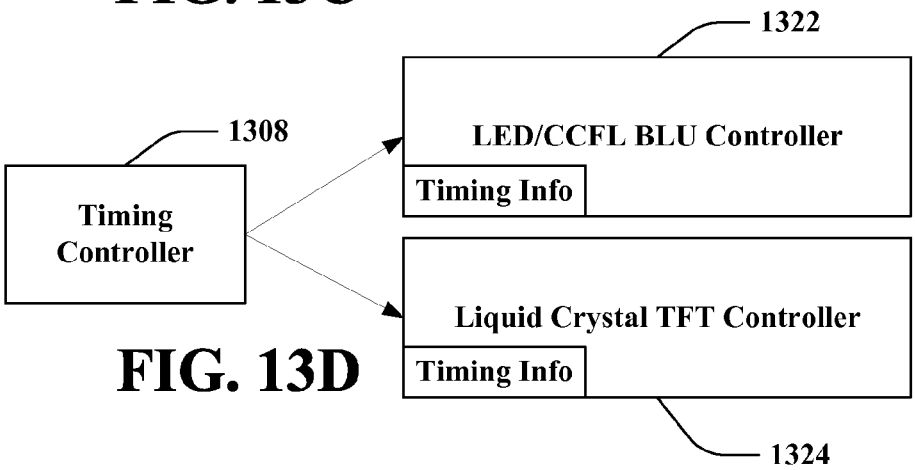

FIGS. 13A, 13B, 13C and 13D are block diagrams of circuits for controlling the BLU and the LCD unit. In FIG. 13A, the LED BLU Controller 1310 and the TFT Gamma controller 1312 are provided on a single integrated circuit. In FIG. 13B, a BLU controller 1314 and an LCD unit controller 1316 is provided on a single integrated circuit. In FIG. 13C, a BLU controller 1318 and an LC TFT unit controller 1320 is provided on a single integrated circuit. In FIG. 13D, the timing controller 1308 independently drives the BLU controller 1322 and the TFT controller 1324, which are provided on separate semiconductor dies.

As shown in FIG. 13D, traditionally, timing controllers 1308 have been independently driving BLU controllers 1322 and TFT controllers 1324. However, with reference to FIGS. 1, 13A, 13B, 13C and 13D, in some embodiments, the BLU controller 102, 1310, 1314, 1318 and the LCD unit controller 108, 1312, 1316, 1320 can be formed on a single semiconductor die. In embodiments that include the timing controller 110, 1302, 1304, 1306 the BLU controller 102, 1310, 1314, 1318, the LCD unit controller 108, 1312, 1316, 1320 and/or the timing controller 110, 1302, 1304, 1306 can be formed on a single semiconductor die. Also with reference to FIGS. 13A, 13B and 13C, the BLU controller 1310, 1314, 1318 and the LC controller 1312, 1316, 1320 can be driven by a single timing controller input. FIGS. 13A, 13B and 13C depicts the BLU controller 1310, 1314, 1318 and the LC controller 1312, 1316, 1320 packaged on a single integrated circuit, in accordance with embodiments described herein.

Referring back to FIGS. 5, 6, 7, 8, 9, 10 and 11, the figures depict flowcharts of methods of operation of LCD systems in accordance with embodiments of the present invention. The LCD systems in which the methods of operation are performed can include a backlight unit and an LCD unit. In some embodiments, the backlight unit and the LCD unit can include structure and be configured as described with reference to FIGS. 1, 2, 3 and 4.

Figure 5:
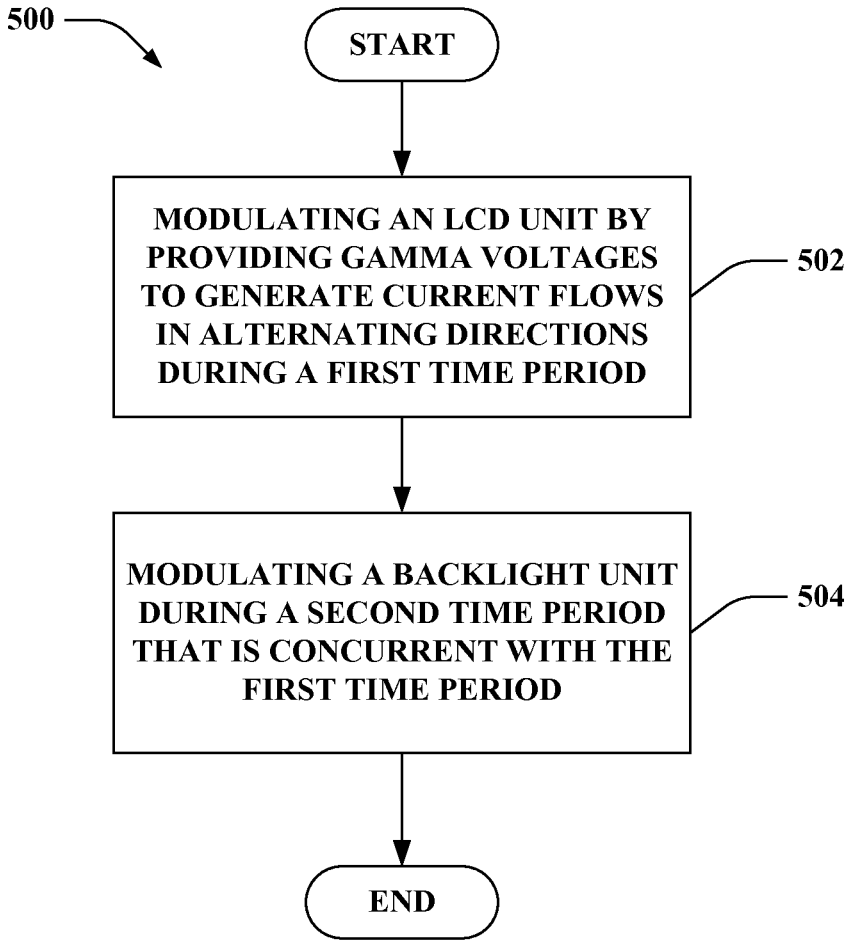
FIGS. 5, 6, 7, 8, 9, 10 and 11 are flowcharts of methods of operation of LCD systems in accordance with embodiments of the present invention.

Turning first to FIG. 5, method 500 is shown. Method 500 can include controlling the LCD unit during a first time period 502. In some embodiments, controlling the LCD unit can include providing to a drain of a TFT in a pixel of the LCD unit, gamma voltage signals (and corresponding gamma voltages), while maintaining a constant value of a voltage at a common node and at the gate of the TFT. In some embodiments, the gamma voltage signals can be provided at a rate corresponding to frames of images displayed on the LCD unit. In some embodiments, the gamma voltage signals can be provided approximately every 30 milliseconds.

In some embodiments, providing the gamma voltage signals (and corresponding gamma voltages) can be performed to alternate the direction of current flow across the TFT between a first direction and a second direction. In various embodiments, alternating the direction of current flow can be performed by providing a first voltage associated with the gamma voltage signal and a second voltage associated with a second gamma voltage signal. The first voltage can have a value greater than a value of the voltage at the common node to provide current flow in the first direction across the TFT. The second voltage can have a value less than a value of the voltage at the common node to provide current flow in the second direction across the TFT. The first direction can be a direction toward the common node and the second direction can be a direction toward the drain. In some embodiments, alternating the direction of current flow can be employed to reduce a likelihood of burn-in on the LCD unit.

Method 500 can also include controlling the backlight unit during a second time period 504. In some embodiments, the first time period can be concurrent with the second time period.

Figure 6:
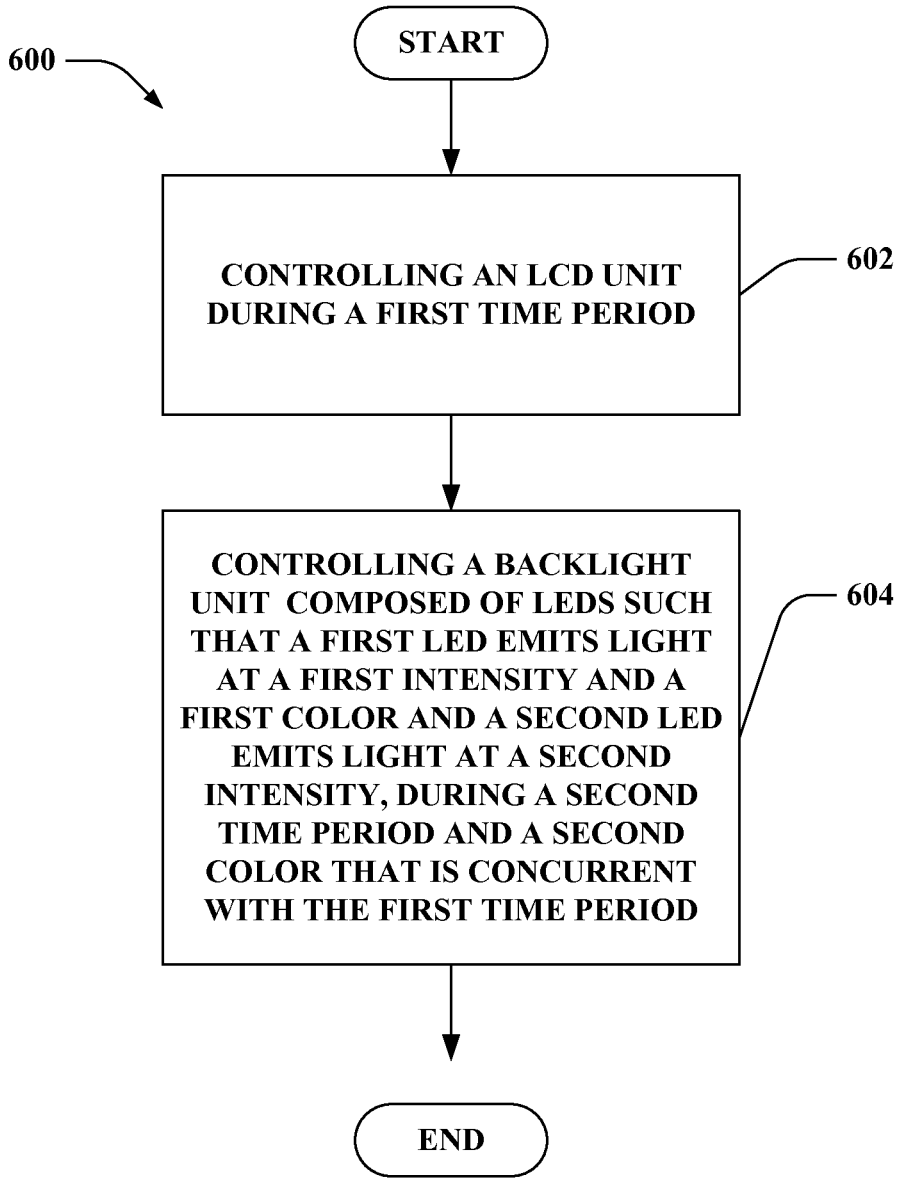

Turning now to FIG. 6, method 600 is shown. Method 600 can include controlling the LCD unit during a first time period 602. Method 600 can also include controlling the backlight unit, which can include a plurality of LEDs, during a second time period 604. In some of these embodiments, a first LED can be controlled to emit light at a first intensity while a second LED can be controlled to emit light at a second intensity and/or color. The first intensity can be correlated with or independent of the second intensity.

Figure 7:
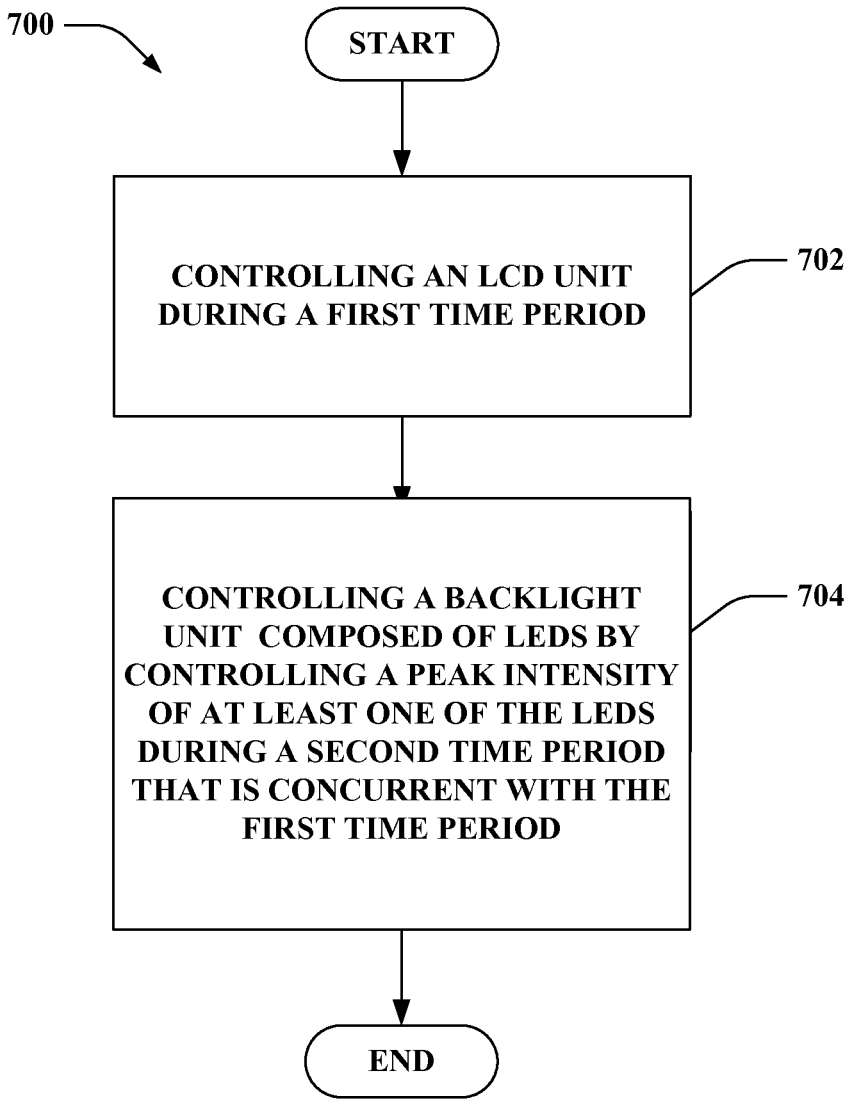

Turning now to FIG. 7, method 700 is shown. Method 700 can include controlling the LCD unit during a first time period 702. Method 700 can also include controlling the backlight unit, which can include a plurality of LEDs, during a second time period 704. In some embodiments, the first time period is concurrent with the second time period.

In some of these embodiments, a first LED can be controlled to emit light at a first intensity while a second and/or third LED can be controlled to emit light at a second and/or third intensity and color. In some embodiments, controlling an LED during the second time period 704 includes controlling a peak intensity of an LED and thereby obtaining a desired average gray scale value of the light emitted from the LED.

Figure 8:
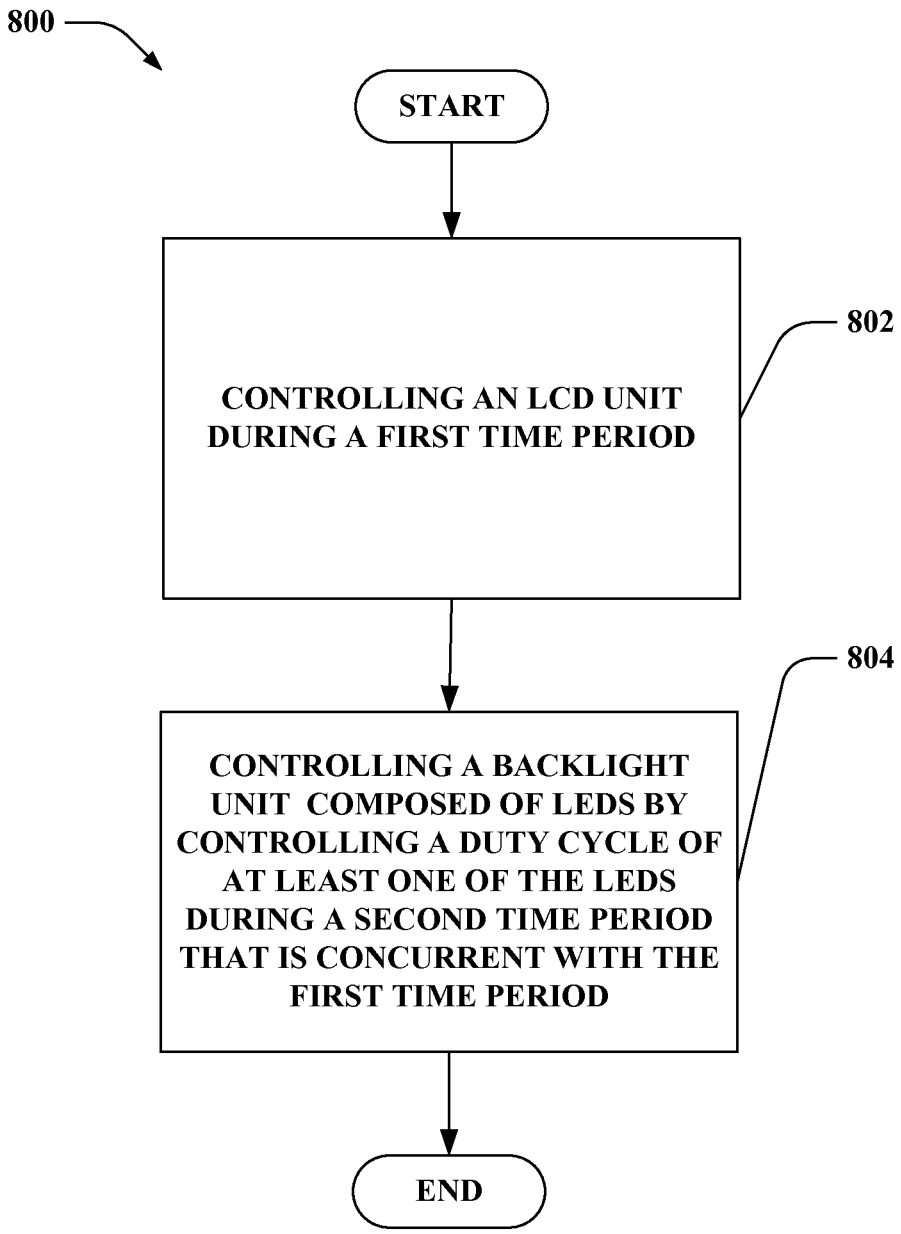

Turning now to FIG. 8, method 800 is shown. Method 800 can include controlling the LCD unit during a first time period 802. Method 800 can also include controlling the backlight unit, which can include a plurality of LEDs emitting various colors and/or intensities during a second time period 804. In some embodiments, the first time period is concurrent with the second time period.

In some of these embodiments, a first LED can be controlled to emit light at a first intensity while a second and/or third LED can be controlled to emit light at a second and/or third intensity and color. In some embodiments, controlling the LED during the second time period 804 includes controlling a duty cycle of the LED and thereby obtaining a desired average gray scale value of the light emitted from the LED.

Figure 9:
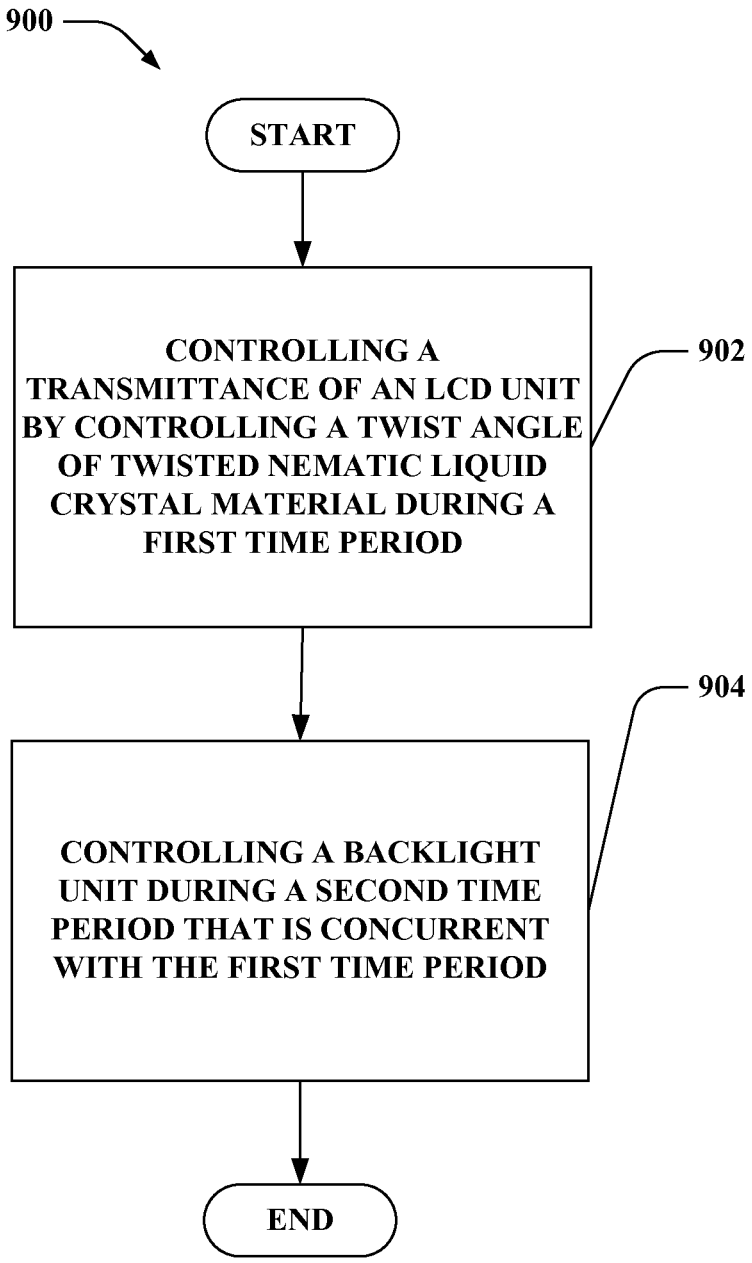

Turning now to FIG. 9, method 900 is shown. Method 900 can include controlling the LCD unit during a first time period. In some embodiments, controlling the LCD unit during the first time period includes controlling a transmittance of light emanated from the LCD unit by altering a twist angle of a twisted nematic liquid crystal ("TNLC") medium 902. The TNLC medium can be disposed in a region overlapping a region of the pixel of the LCD unit. Method 900 can also include controlling the backlight unit during a second time period 904. In some embodiments, the first time period can be concurrent with the second time period.

Figure 10:
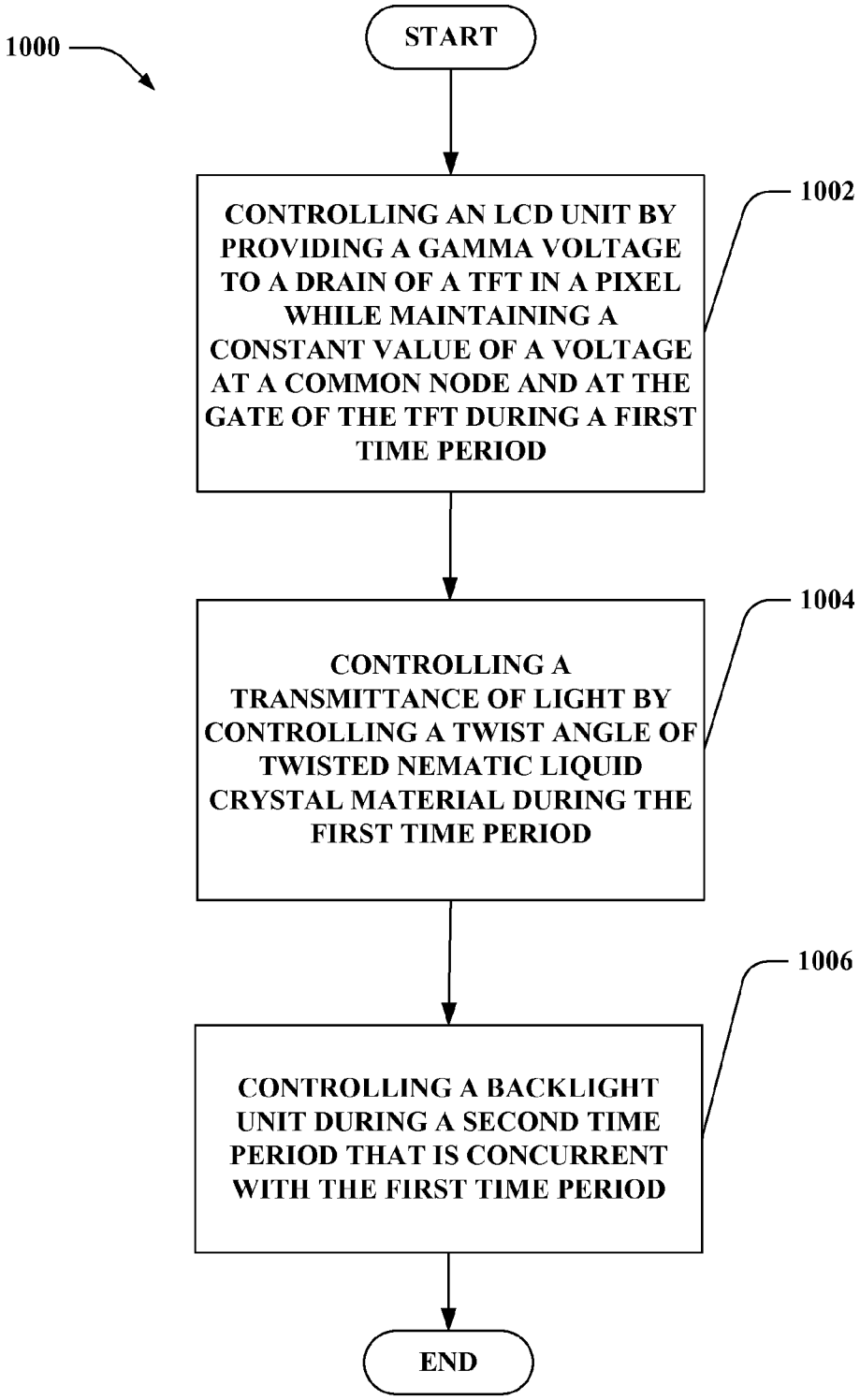

Turning now to FIG. 10, method 1000 is shown. Method 1000 can include controlling the LCD unit during a first time period. In some embodiments, controlling the LCD unit during the first time period can include providing, to a drain of a TFT in a pixel of the LCD unit, a gamma voltage corresponding to a gamma voltage signal to generate a first color, while maintaining a constant value of a voltage at a common node and at the gate of the TFT 1002. In some embodiments, the common node can be coupled to the source of the TFT.

Controlling the LCD unit during the first time period can also include controlling a transmittance of light emanated from the LCD unit by controlling a twist angle of a TNLC material of the LCD unit 1004.

Method 1000 can also include controlling the backlight unit during a second time period 1006. In some embodiments, the first time period can be concurrent with the second time period.

Figure 11:
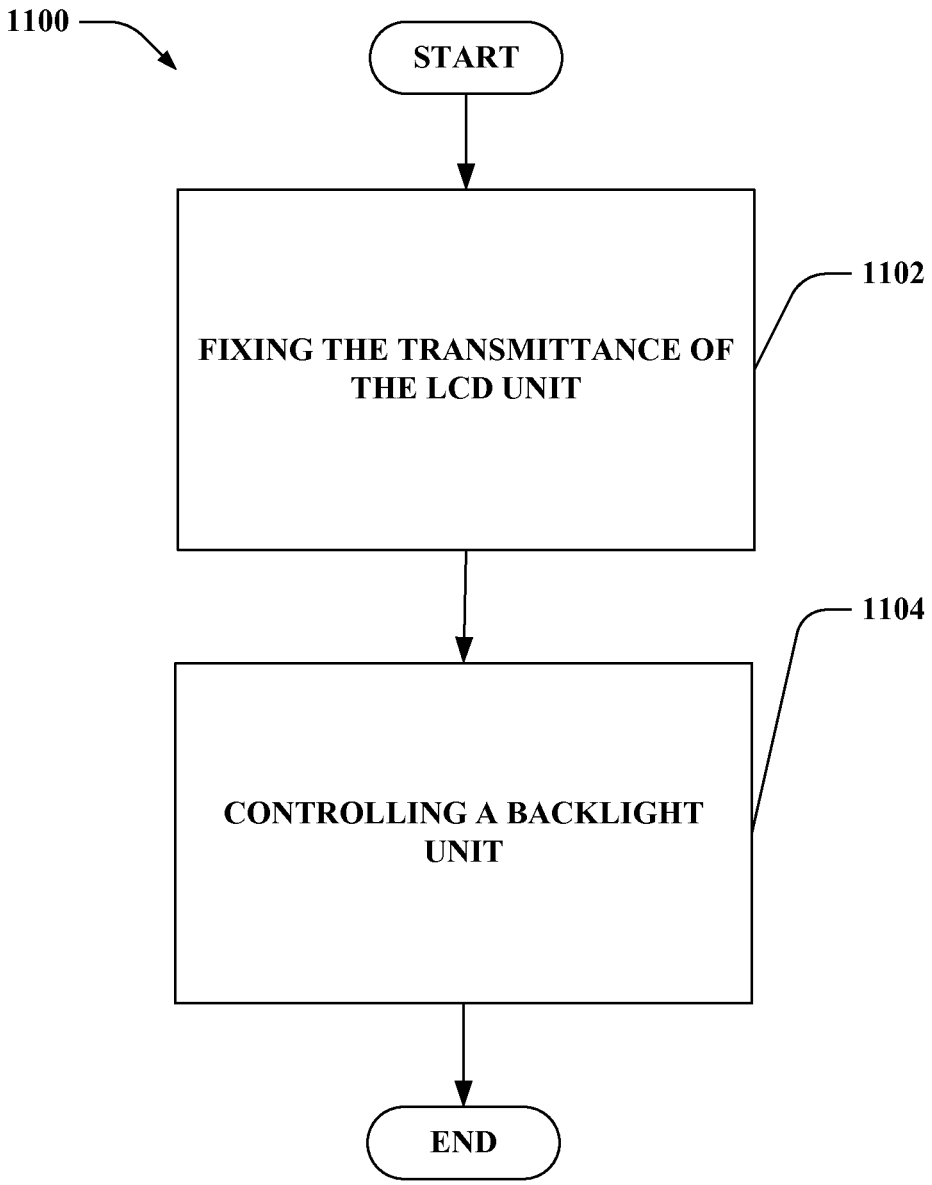

Turning first to FIG. 11, method 1100 is shown. Method 1100 can include fixing the transmittance of the LCD unit 1102 during a first time period 1102. Method 1100 can also include controlling the backlight unit during a second time period 1104. In some embodiments, the first time period is not concurrent with the second time period. In these embodiments, during the second time period, the transmittance of the LCD unit can be fixed while the backlight unit is controlled. These embodiments can minimize motion artifacts displayed from the LCD unit, since the response time of the backlight unit can be much faster than that for the LCD unit.

In some embodiments, in the LCD system, only the backlight unit 104 is controlled and the transmittance of the LCD unit remains fixed during the first time period and the second time period.

Because the light emitted from the backlight unit 104 can be controlled faster than the control of the transmittance of the LCD unit, motion artifacts can typically appear on the LCD unit due to the sample-and-hold nature of the LCD unit. Accordingly, the method 1100 can fix the transmittance of the LCD unit and solely control the backlight unit to minimize the motion artifacts. Since controlling the backlight unit can be performed by dynamically scanning to mimic a traditional cathode ray tube ("CRT") display, method 1100 can minimize motion artifacts as well as minimize the complexity of the electronics for driving the TFTs of the LCD unit. In some embodiments, the LCD unit can be replaced by any other simpler transparent unit that has a fixed, or substantially fixed, transmittance, e.g., a glass plate. The intensity can be modulated by modulating LED output. The LEDs can be color LEDs. Alternatively, the LEDs can be white and color filters can be placed behind or in front of the glass or transparent film.

Figure 12:
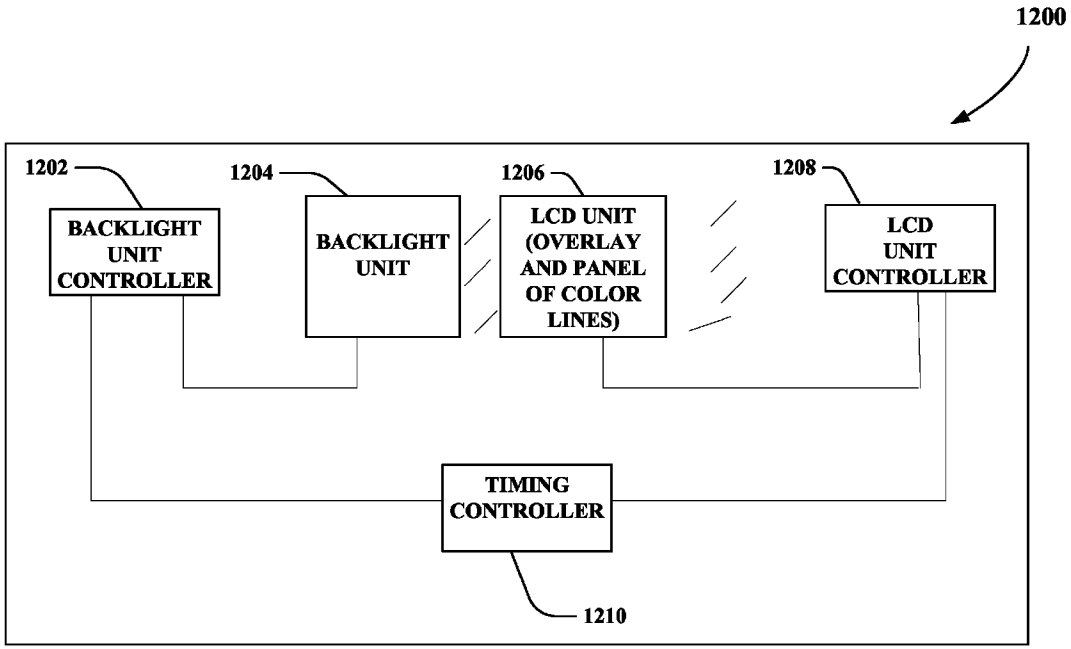
FIG. 12 is a block diagram of another LCD system in accordance with an embodiment of the present invention.

FIG. 12 is a block diagram of another LCD system in accordance with an embodiment of the present invention. The LCD system 1200 can include a backlight unit controller 1202 operably coupled to a backlight unit 1204 and an LCD unit 1206 operably coupled to an LCD unit controller 1208. In some embodiments, the LCD system 1200 can also include a timing controller 1210 operably coupled to the backlight unit controller 1202 and the LCD unit controller 1208 for controlling the backlight unit controller 1202 and the LCD unit controller 1208 to provide synchronized control of the backlight unit 1204 and the LCD unit 1208. Synchronized control can include control of the backlight unit 1204 and the LCD unit 1208 during concurrent or simultaneous time periods.

The backlight unit 1204 can have a plurality of light sources (not shown). For example, the light sources can be LEDs. Each of the plurality of light sources can be disposed to emit light at any one of a plurality of intensities. The backlight unit controller 1202 can control the backlight unit 1204 (or the LEDs) to emit light at the one or more intensities.

The LCD unit 1208 can be composed of a plurality of pixels (not shown) and liquid crystalline medium (not shown). Each of the plurality of pixels can have corresponding circuitry including a plurality of color filters controllable to transmit a respective color light from the LCD unit 1204. In some embodiments, the liquid crystalline medium can be a TNLC medium.

In some other embodiments, LED themselves can emit different color light. The color filters are optional components in such systems and embodiments thereof can include (or not include) the color filters.

The LCD system can also include an LCD unit controller 1206 operably coupled to the LCD unit 1204 and configured to selectively control one or more of the color filters to transmit a color. In some embodiments, the LCD unit controller 1206 can also control a brightness of the color emitted from the selected one or more color lines. The LCD unit 1206 can be substantially transparent and located adjacent to the backlight unit 1204 for receiving the light emitted from the backlight unit 1204 and emanating a combination light including the light emitted from the backlight unit 1204 and the color transmitted from the selected one or more color filters.

Accordingly, from one pixel to another pixel, the intensity of the light emitted from the backlight unit 1204 and the light transmitted through the color filters selected can be controlled with the LCD system 1200. The brightness and contrast of the corresponding pixel can be controlled by increasing or decreasing the voltage provided to the LCD unit 1206 by the LCD unit controller 1208. A higher voltage, for example, can lead to brighter pixel illumination and a brighter picture.

Referring to FIGS. 1, 2 and 12, in the embodiments disclosed herein, because the one or more LEDs can be controlled to different levels of intensity, and are therefore not simply turned on or off, a level of modulation can be set for the backlight unit 104, 1204 while a transmittance or luminosity can be concurrently, or simultaneously, set for the LCD unit 106, 1206. Because the backlight unit 104, 1204 can be set to a selected intensity, this can reduce the setting that would typically have to be provided for the transmittance or luminosity of the LCD unit 106, 1206. For example, if the backlight unit 104, 1204 were set to emit bright light, a voltage corresponding to a gamma voltage signal at the TFT 206 adapted to control red light may have to be set to a very high value to obtain a true red color. A very high value can correspond to a large number of bits to be provided to the drain DAC. In the embodiments described herein, however, the intensity of the light from the backlight unit 104, 1204 can be reduced. As a result, a lower value of the voltage corresponding to the gamma voltage signal for the TFT 206 can be set while, in some embodiments, still achieving the desired bright red color light from the LCD unit 106, 1206. As such, in these embodiments, the number of bits required to be input to the drain DAC can be three to six bits, as opposed to a greater number of bits.

It is to be understood that the embodiments described herein can be implemented in hardware, software or a combination thereof. For a hardware implementation, the embodiments (or modules thereof) can be implemented within one or more application specific integrated circuits (ASICs), mixed signal circuits, digital signal processors (DSPs), digital signal processing devices (DSPDs), programmable logic devices (PLDs), field programmable gate arrays (FPGAs), processors, controllers, micro-controllers, microprocessors and/or other electronic units designed to perform the functions described herein, or a combination thereof.

When the embodiments are implemented in software, firmware, middleware or microcode, program code or code segments, they can be stored in a machine-readable medium (or a computer-readable medium), such as a storage component. A code segment can represent a procedure, a function, a subprogram, a program, a routine, a subroutine, a module, a software package, a class, or any combination of instructions, data structures, or program statements. A code segment can be coupled to another code segment or a hardware circuit by passing and/or receiving information, data, arguments, parameters, or memory contents.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A liquid crystal display (LCD) system, comprising:

a backlight unit disposed to emit light at a plurality of intensities, wherein the backlight unit includes a plurality of light emitting diodes, one or more of the plurality of light emitting diodes being operably coupled to the backlight unit controller to be controlled to emit light at one of the plurality of intensities;

a backlight unit controller operably coupled to the backlight unit and configured to control the plurality of intensities of the light emitted from the backlight unit;

an LCD unit located adjacent to the backlight unit for receiving the light emitted from the backlight unit, and configured to be controlled to emanate light at a selected luminosity, wherein the LCD unit comprises a plurality of pixels, one or more of the plurality of pixels corresponding to:

a portion of a liquid crystalline medium adapted to provide a transmittance of the light emitted from a corresponding light emitting diode of the backlight unit; and a plurality of transistors adapted to control the LCD unit by modulating one or more reference voltages; and an LCD unit controller operably coupled to the LCD unit and configured to control a luminosity of the emanated light, wherein the backlight unit and the LCD unit are configured to be controlled concurrently, and wherein the luminosity of a given pixel is controlled by varying the intensity of a light emitting diode corresponding to the given pixel and by varying the transmittance of the liquid crystalline medium corresponding to the given pixel, and wherein the backlight unit controller and LCD unit controller are configured so that a plurality of most significant bits of image data provide coarse intensity variation of the given pixel using the light emitting diode corresponding to the given pixel and a plurality of least significant bits provide finer intensity variation of the given pixel using the liquid crystalline medium, and wherein the given pixel comprises a pixel circuit receiving a gamma voltage, the gamma voltage dictating a luminosity of light emitted from the given pixel and controlling alternating direction of current flow across the pixel circuit, wherein the LCD unit controller and the backlight unit controller are fabricated on an integrated circuit, and wherein the given pixel comprises a pixel circuit including at least three transistors adapted for controlling emission of respective color lights, wherein each of the transistors receives a respective gamma voltage from a digital-to-analog converter coupled to a gamma voltage generator, wherein each of the transistors is a thin film transistor (TFT) and TFT gamma voltage controlling electronics are configured to control a TFT gamma voltage for the TFT transistor, wherein the source of the TFT transistor is coupled to a common node, wherein a current flow across the TFT transistor is controlled based on a difference between a voltage corresponding to the TFT gamma voltage and a voltage at the common node, wherein the backlight unit controller and the TFT gamma voltage controlling electronics are fabricated on the integrated circuit.

2. The LCD system of claim 1, wherein the backlight unit controller is configured to control a first light emitting diode to emit light at a first one of the plurality of intensities and to control a second light emitting diode to, at the same time, emit light at a second one of the plurality of intensities, and wherein the first one of the plurality of intensities is independent of the second one of the plurality of intensities.

3. The LCD system of claim 2, further comprising a timing controller operably coupled to the backlight unit controller and the LCD unit controller for causing synchronized control of the backlight unit and the LCD unit by outputting one or more signals adapted to be received by the backlight unit controller and the LCD unit controller, wherein the one or more signals are for causing the backlight unit controller to control one or more of the plurality of light emitting diodes to emit light at one of the plurality of intensities during a first time period, and wherein the one or more signals are for causing the LCD unit controller to control the LCD unit to emanate light at the selected luminosity during a second time period, the first time period being concurrent with the second time period.

4. The LCD system of claim 1, wherein the liquid crystalline medium is a twisted nematic liquid crystal medium adapted to bend into one of a plurality of twist angles to provide the transmittance of the light emitted from the backlight unit.

5. The LCD system of claim 1, further comprising:

a plurality of gamma voltage generators; and a plurality of gate data signal generators, one or more of the plurality of transistors being a thin film transistor (TFT) that is a field effect transistor having:

a drain coupled to one of the plurality of gamma voltage generators;

a gate coupled to one of the plurality of gate data signal generators; and a source coupled to a storage capacitor that is coupled to a common voltage, one or more of the plurality of the gamma voltage generators being configured to output a gamma voltage signal for controlling a transmission of a color signal, and one or more of the plurality of the gate data signal generators being configured to output a gate data signal for controlling a current flow from the drain to the source of the TFT.

6. The LCD system of claim 5, further comprising:

a plurality of first digital-to-analog converters; and a plurality of second digital-to-analog converters, wherein the gate of the TFT is coupled to one of the plurality of gate data signal generators one of the plurality of first digital-to-analog converters, and wherein the drain of the TFT is coupled to one of the plurality of gamma voltage generators via one of the plurality of second digital-to-analog converters.

7. The LCD system of claim 1, wherein one or more of the plurality of transistors is a thin film transistor (TFT) having a drain, a source and a gate, the LCD system further comprising:

a backlight unit modulator; and electronics for controlling a voltage at the drain, the source or the gate, wherein the backlight unit modulator and the electronics for controlling are fabricated on the integrated circuit.

8. The LCD system of claim 1, wherein the LCD unit controller is configured to control gamma voltage modulation applied to the source or to the drain of the TFT.

* * * * *

UNITED STATES PATENT AND TRADEMARK OFFICE

CERTIFICATE OF CORRECTION

PATENT NO. : 8,698,728 B2
APPLICATION NO. : 12/610941
DATED : April 15, 2014
INVENTOR(S) : Hendrik Santo et al.

It is certified that error appears in the above-identified patent and that said Letters Patent is hereby corrected as shown below:

On the Title Page: Item (56) References Cited under (Other Publications), delete "Wntten" and insert --Written--, therefor.

In the Specification:

Column 2, Line 53 delete "controller;" and insert --controller.--, therefor.

Signed and Sealed this
Eighth Day of July, 2014

Michelle K. Lee

Michelle K. Lee
*Deputy Director of the United States Patent and Trademark Office*